United States Patent [19]

Etcheparre et al.

[11] Patent Number: 5,044,238

[45] Date of Patent: Sep. 3, 1991

[54] CUTTING AND PUNCHING APPARATUS FOR SHEET MATERIAL

[75] Inventors: Jean Etcheparre; Bernard Etcheparre, both of Bordeaux, France

[73] Assignee: Lectra Systems, Cestas, France

[21] Appl. No.: 403,673

[22] Filed: Sep. 6, 1989

[30] Foreign Application Priority Data

Sep. 23, 1988 [FR] France ..... 88 12488

[51] Int. Cl.[5] ..... B26D 3/14

[52] U.S. Cl. ..... 83/76.1; 83/49; 83/561; 83/639.1; 51/250

[58] Field of Search ..... 83/49, 76.1, 399, 561, 83/639.1, 917; 51/250

[56] References Cited

U.S. PATENT DOCUMENTS 2,911,772 11/1959 Gronemeier .
3,741,062 6/1973 Glastra .
4,587,873 5/1986 Gerber .
4,667,553 5/1987 Gerber et al. .

FOREIGN PATENT DOCUMENTS 2583332 6/1985 France .
2175828A 12/1986 United Kingdom .

*Primary Examiner*—W. Donald Bray
*Attorney, Agent, or Firm*—Barry Evans

[57] ABSTRACT

A cutting and punching apparatus for sheet material, designed to be movably mounted on an automatic cutting machine, having a cutting tool and a punching tool, wherein said apparatus comprises means for vibrating said cutting tool, means for vertically displacing said cutting tool, means for rotating said cutting tool, means for sharpening said cutting tool, means for vertically displacing said punching tool, means for rotating said machine tool, and a supporting base on which are grouped in a compact manner all said means, which means being operable both simultaneously and independently of each other.

15 Claims, 7 Drawing Sheets

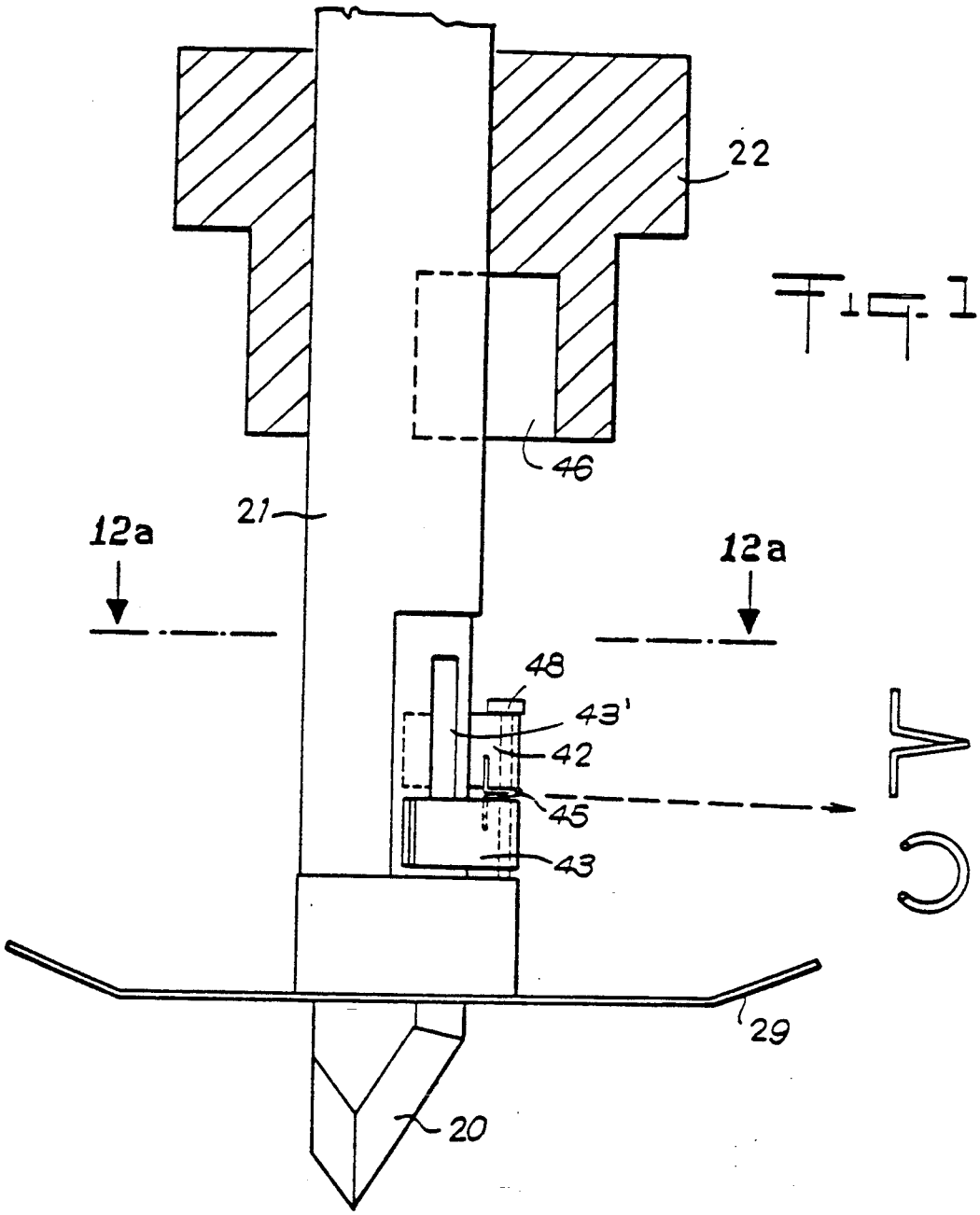
Fig. 12
Fig. 12a
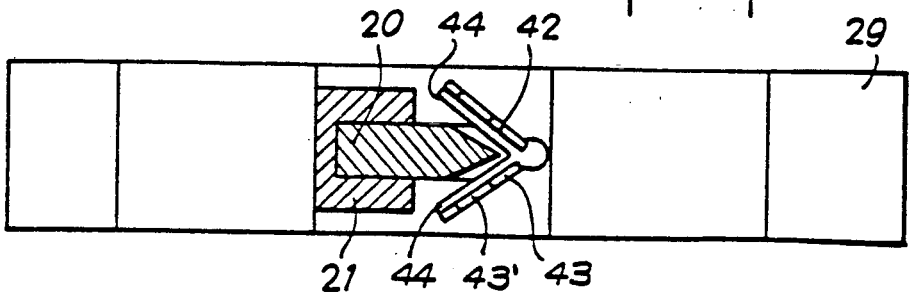

Fig. 11
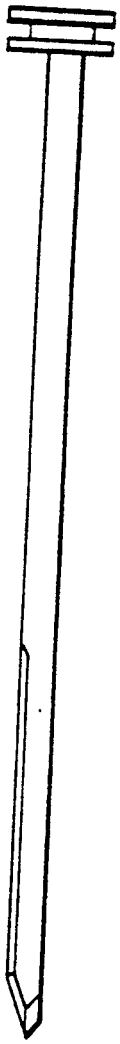
Fig. 14
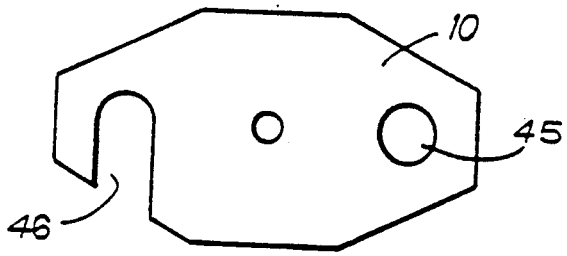
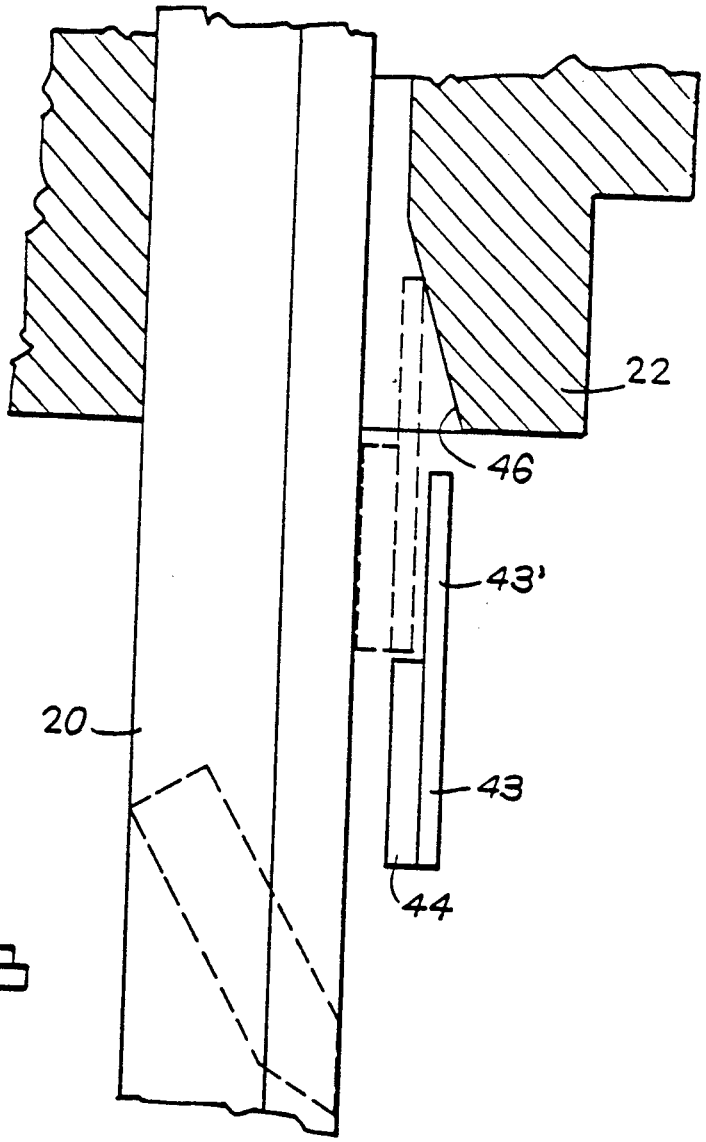
Fig. 13

CUTTING AND PUNCHING APPARATUS FOR SHEET MATERIAL

FIELD OF THE INVENTION

The present invention relates to a cutting and punching apparatus for sheet material, such as cloth, designed to be installed in an automatic, numerically controlled cutting machine. Such apparatus is generally mounted on a movable assembly comprising a beam that is longitudinally displaceable along guide rails located above a cutting table, together with a carriage displaceable along the beam and thus forming a cross-coordinate system.

BACKGROUND OF THE INVENTION

The present invention proposes to solve the technical problem associated with cutting out a sheet, or a pile of sheets (a few sheets only) using a vibrating metal blade while simultaneously seeking the smallest possible weight to allow very high speed displacement and acceleration of the tool, small occupied space, great simplicity for maximum possible reliability, and the provision of a punch for perforating the material.

Moreover, the adoption of a vibrating blade imposes a number of constraints, such as a high vibration frequency, which in turn calls for very low mass moving parts, controlled rotational drive of the blade to follow the tangent of the cutting profile, very small blade dimensions, and the possibility of raising and lowering of the blade to free the latter completely from the cutting plane, in particular when changing cutting profiles. Furthermore, sharpening of the vibrating blade must be carried out automatically.

SUMMARY OF THE INVENTION

The present invention aims to overcome these problems for the first time and in a satisfactory way, using a cutting and punching apparatus for sheet material, intended to be movably mounted on an automatic cutting machine, including a cutting tool and a punching tool, wherein said apparatus has means for vibrating the cutting tool, means for rotating the cutting tool, means for sharpening the cutting tool, means for vertically displacing the punching tool, means for rotating the punching tool and a support base on which are compactly grouped all said means which are capable of being implemented simultaneously and independently of each other.

According to the invention, the cutting tool is preferably a vertical punch.

According to a characteristic of the invention, the said cutting tool vibrating means comprise a flywheel that is directly coupled to a shaft of an electric motor mounted inside a movable casing, a freely rotatable crank wrist mounted on the external face of said flywheel, at an excentric position with respect to the rotation axis of said flywheel, and possessing an open, radial slot inside which comes to slide horizontally a T-shaped tongue element of a slider adjusted so as to slide freely and without rotation along a hollow guide whose axis is concurrent with that of the flywheel, said slider coming into engagement in the upper part of the blade while allowing free rotation of the latter.

According to another characteristic of the invention, said means for vertical displacement of the cutting tool comprise a pneumatic jack, two guide columns supported at their top ends by a connecting element, a compression spring located between the base and the movable housing enclosing the electric motor.

According to yet another characteristic of the invention, said means for rotating the cutting tool comprises a servo motor connected to the rotating guide that drives said blade into rotation by means of a toothed belt and two pulleys.

According to the invention, said cutting tool sharpening means comprise:

- two abrasive tabs articulated around a common vertical axis affixed to a pressing heel and held apart by a spring so as to be tangential to the blade without touching the latter,
- inclined planes located on the lower clearing of the guide and provided to squeeze the tables into contact with the blade when the latter is raised to a high position.

Said means for vertical displacement of the punching tool comprise:

- a pneumatic jack affixed to the connecting element,
- a guide movably coupled within a rotating hub of the base, the lower part of said punching tool sliding through the guide and its upper part being centred in the end of the rod of the jack,
- a compression spring located between the upper face of the hub and the lower face of the rod of the jack, and through which passes the punch.

Also according to the invention, said means for rotating said punching tool comprise a motor, pulleys respectively attached to the hub and motor shaft and on which is mounted a round belt.

BRIEF DESCRIPTION OF THE DRAWINGS

The invention shall be more clearly understood upon reading the following description with the help of the appended drawings in which:

FIG. 11 is a side view of the cutting tool;

FIGS. 12 and 12*a* are a respectively lateral view and cross-sectional view along FF of the sharpening means.

FIG. 13 is a detailed view of the sharpening means;

FIG. 14 is a plan view of the clamping plate which allows fast exchange of the blade.

DETAILED DESCRIPTION OF THE PREFERRED EMBODIMENT

Figure 2:
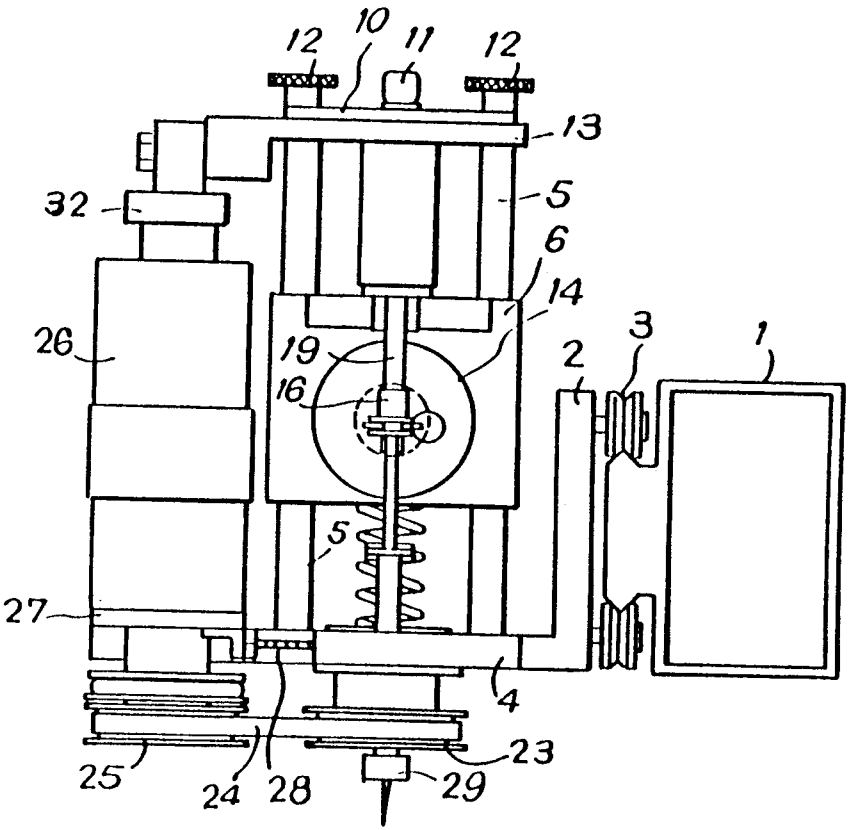
FIGS. 1, 2, 3 and 4 respectively show side, front, plan and rear views of the inventive apparatus.
Figure 1:
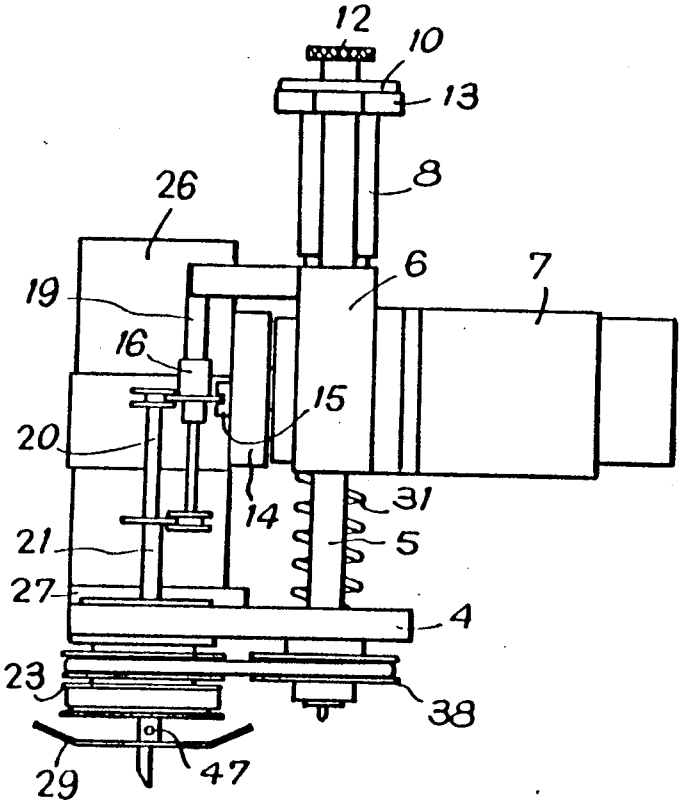
Figure 4:
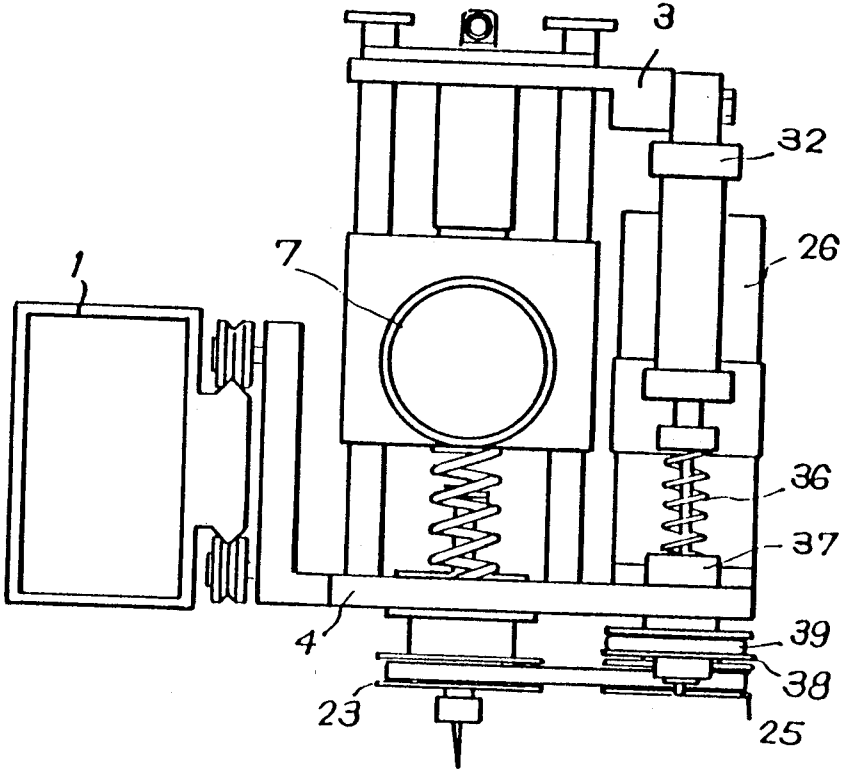
Figure 3:
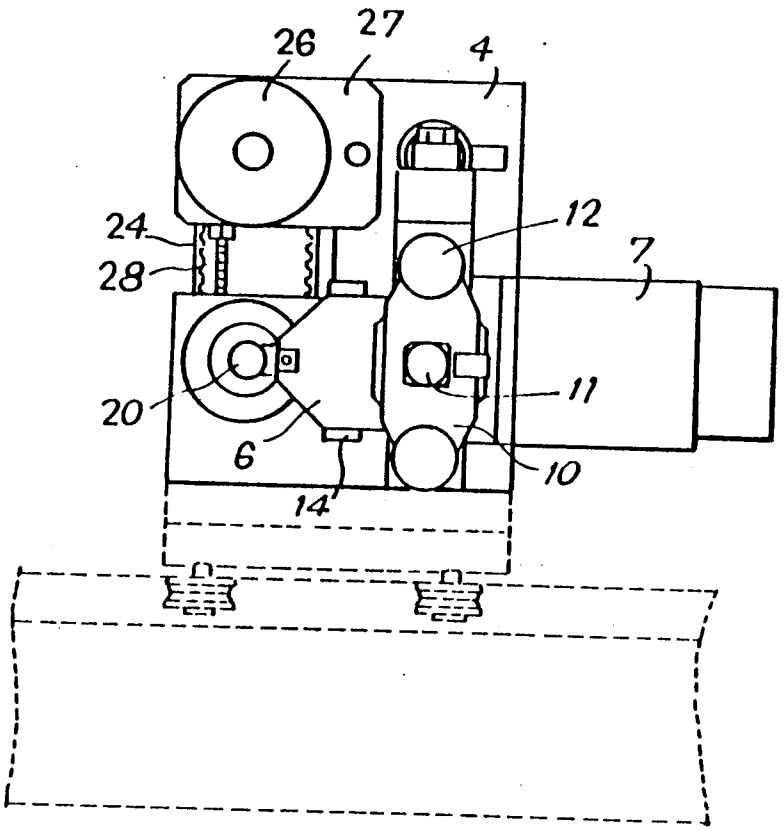

FIGS. 1 to 5 show the different means forming the inventive apparatus.

These means are all joined to each other by means of a base (4). The above figures also depict two guiding columns (5) that allow vertical up-and-down movement of the cutting tool. The two columns are held at their top parts by a connecting element or flange (13) and an articulated support (27) on which is mounted a motor serving to drive both the means for rotating the cutting tool and the punching tool.

The base is affixed to a movable carriage (2) that displaces along a beam (1) by means of rollers (3).

Vibration of the vertical blade is achieved by conversion of a continuous rotational movement into a reciprocating rectilinear movement. This is obtained by use of vibration means in association with an excentric device.

The above means comprise a flywheel (14) that is directly coupled to the shaft of an electric motor (7). The assembly is mounted inside the movable housing (6) which slides vertically along the two guiding columns (5). On the external face of the flywheel is mounted a freely rotatable crank wrist (15) that is excentric with respect to the rotation axis of the flywheel (14).

As can be seen from FIGS. 7 to 10, the amplitude of the blade's vibration will depend on the above mentioned excentricity. The crank wrist includes radial, open slot into which slides a tongue of a slider (16) that is adjusted so as to slide freely within the guide (19) while being restrained from turning within the latter (owing to the square cross-section).

The slider (16) comprises a number of active parts. The first part is formed by a vertical, square section sleeve that is adjusted on the guide (29). The second part is formed by a tongue (17) that is affixed to the lower base of the sleeve whose ends have different shapes. The tongue (17) is T-shaped and arranged so as to be slidable within the slot of the crank wrist (15). When the flywheel is set into rotation (6), the crank wrist (15) drives the tongue (17), as a result of its excetricity, and thus also the active slider (16), the tongue (17) being free to slide horizontally.

The other end of the T-shaped tongue (27) is shaped so as to engage into the upper part of the vertical blade (20) to drive the latter into rotational movement while leaving the blade free to rotate.

Figure 5:
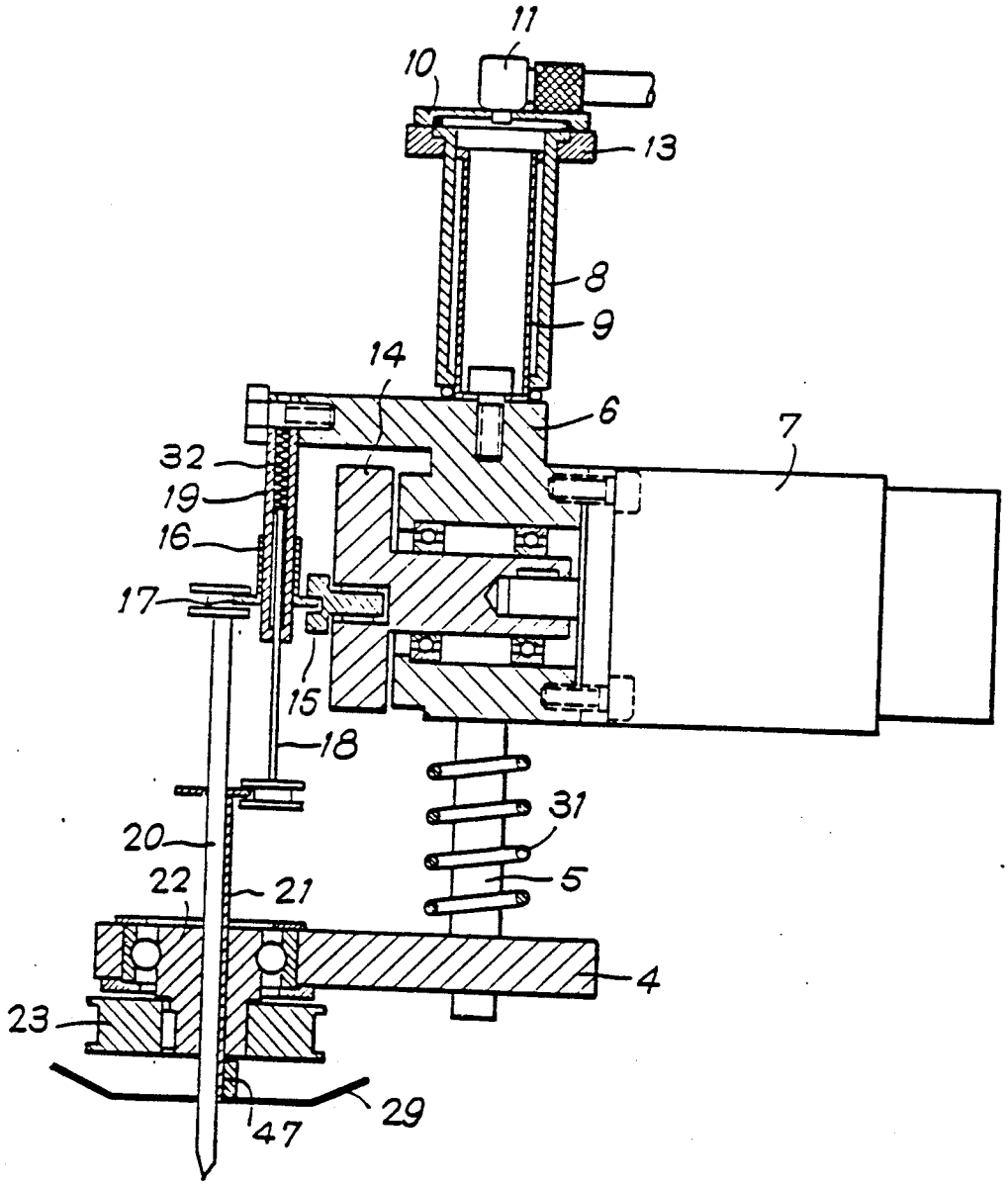
FIG. 5 is a partial sectional view of the vibration means for the cutting tool.

With reference to FIG. 5, the blade (20) is guided vertically by a slider (24) which is itself vertically guided in a guide (22) mounted freely rotating on the base (4). The guiding section is square, and thus rotation of the slider (21) with respect to guide section (22) is impossible: only a vertical relative translation is possible. This device thus enables a rotation of the guide (22) to be transmitted to the blade (20) without hindering the vibrational movement of the latter. The length of the slider (21) is made such that the blade (20) does not flex under the cutting forces. The guide (22) is mounted into the base (4) via ball bearings.

To ensure rapid exchange of the blade (20), some of the elements have been specially configured to ease dismantling. With reference to FIG. 5, the cylinder of the pneumatic jack (8) is held in position by a flange (13) via a flange plate (10). This flange plate (10) (FIG. 14) is thus placed above the cylinder (8), the upper part of which has a shoulder section that fits inside a bore of the flange (13). A standard torroidal type sealing joint is fitted between the flange plate (10) and the jack (8) to prevent gas leakage. Compressed air is admitted through a joint (11). The flange plate (10) is affixed by means of two knurled head screws (12) (see FIG. 2). The flange plate (10) has a smooth hole (45) on one side and a laterally open hole (46) on the other, through which the screws (12) passes. Thus, if the screws (12) are loosened, without being removed, the flange plate (10) can pivot around the smooth holes (45). This in turn frees the cylinder (8), which can then be cleared from the top. Consequently, the housing (6) can be raised and the blade (20) fully cleared from the slider (21).

The slider (21) also serves to support, at its lower part, a pressure heel (29) for pressing or flattening the cutting material against its cutting support. The heel should accommodate for the variable heights of material to be cut. The up-and-down movement is mechanically linked to that of the housing (6), so obviating the need for a separate actuator. The device employed for vertical displacement of the heel (29) comprises a guide rod (18) that is vertically guided within the bore of the upper guide (19), and a compression spring (31) located inside the bore, above the guide rod (18). The spring thus pushes the guide rod (18) towards the bottom, until the latter reaches its lower abutment formed by a small shoulder. The lower end of the rod (18) has the shape of a reel that engages with a disk affixed to the upper part of the slider (21). Such a coupling arrangement provides a vertical translational linking of the rod (18) with respect to the slider (2) while leaving the slider completely free to rotate. When the housing (6) is set in a low position, the spring (32) pushes the rod (18) towards the bottom, and the rod (18) in turn pushes the slider (21) and the heel (29) against the material spread on the cutting table. Thus, irrespective of the amplitude of the movement or of the position of the housing (6), the pressure heel (29) will always adapte to the height of the cutting material and produce a contact pressure as a function of the loading of the spring (32).

It is necessary that the blade (21) be able to move up and down so as to clear itself from, or completely penetrate the cutting material, independently of its vibrational movement. Indeed, all non-cutting displacements are carried out with the blade in a high position.

To that end, use is made of a vertical blade displacement means comprising a pneumatic jack (8) whose cylinder is affixed to the connecting element or flange (13) supporting the two guide columns (5), while the piston is fixed to the vibration housing (6). Compressed air is fed into the cylinder through its upper end alone, via connector (11). The jack is of the single-action jack type. The return travel towards the high position is ensured by a compression spring (3) located between the base (4) and the lower part of the housing (6) between the columns (5).

The vertical guiding of the housing (6) is accurately provided by the two guide columns (5).

Owing to the non-negligible width of the blade—albeit narrow in the present application it is essential that the cutting edge always remains aligned with the displacement axis, i.e. that it should remain constantly aligned with the tangent of the cutting profile.

To that end, use is made of rotation means comprising a servo-motor (26) that is feedback controlled in both speed and position, a first pulley (25) affixed to the shaft of the motor (26), a second pulley (25) affixed to the lower part of the guide (22) and a toothed transmission belt (24) connecting the two pulleys (23, 25) and thus driving the blade (20) into rotation.

The servo-motor (26) is vertically mounted on a support (27) that articulates around the base (4). This allows the belt (24) to be stretched between the pulleys (23, 25), e.g. by the use of a screw (28), the screw being inserted into the base (4) and its head coming to bear against the articulated support (27) located just opposite. Unscrewing of the screw (28) pushes back the articulated support (27).

In some applications, it may be required to perforate the cutting material at secific points to provide markers for when it comes to assembling the cut pieces. In such instances, the punching tool is used in conjunction with the cutting tool and is likewise controlled numerically.

In order to leave as clean a mark as possible, it is necessary to rotate the punching tool—consisting of a vertical punch—around its own axis as it penetrates into the material.

Figure 6:
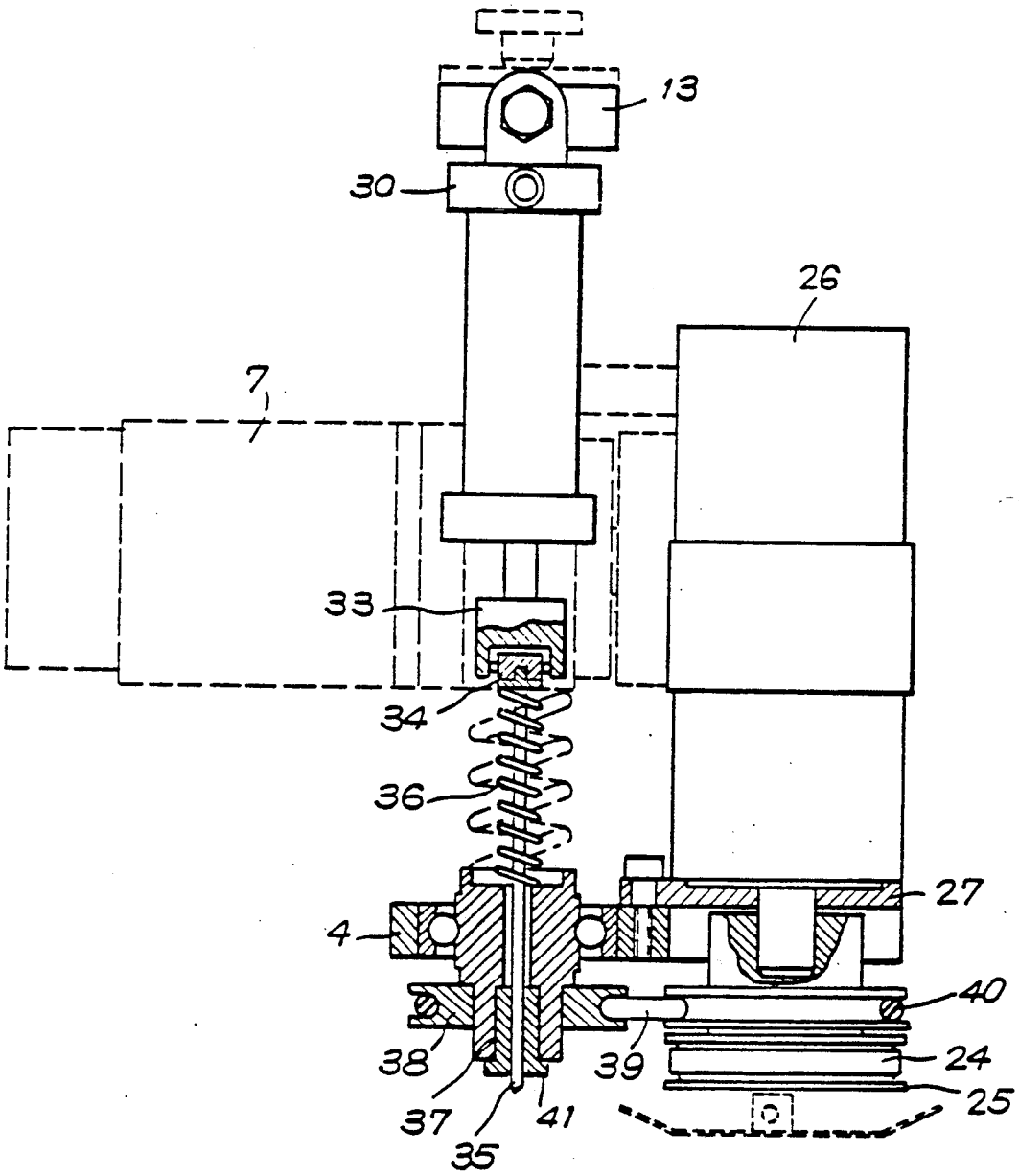
FIG. 6 is a partial sectional view of the vertical displacement means and rotation means of the punching tool.
Figure 8:
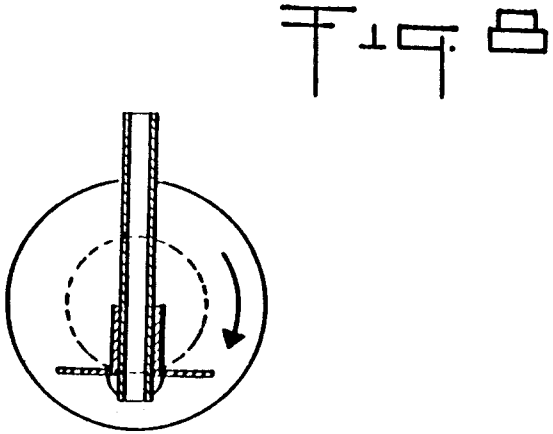
FIGS. 7, 8, 9 and 10 are detailed partial sectional views of the vibrating means for the cutting tool.
Figure 10:
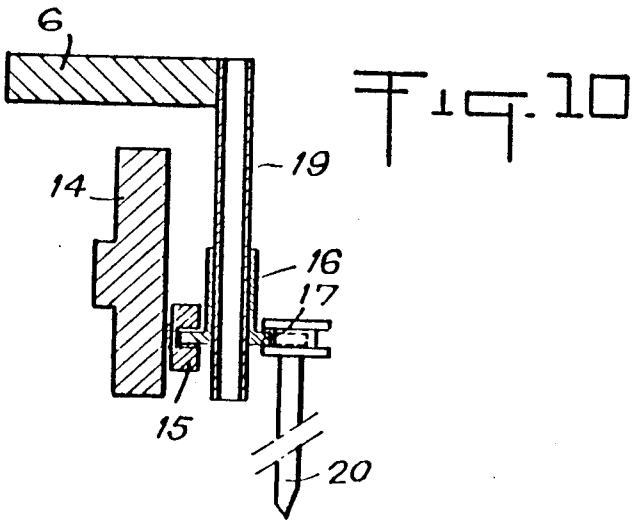
Figure 7:
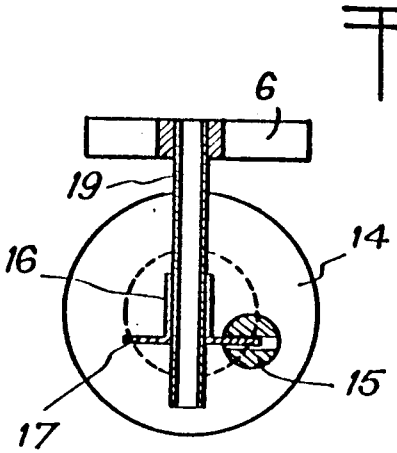
Figure 9:
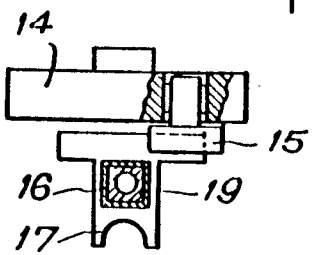

This operation is achieved by means (FIG. 6) for rotating and vertically displacing the punch.

Such means are based on the use of a vertical punch (35) which can be raised or lowered by a pneumatic jack (30) and which is rotatably driven by a motor (26). Preferably, the motor (26) is the same as that used for rotating the blade. This avoids the use of an additional motor and contributes towards reducing the size of the assembly.

The punch (35) is slidably mounted in a guide (41) which is itself mounted on a hub (37). The hub (37) is guided in rotation within the base (4) by means of ball bearings. A holding means, e.g. a clip, fastens the guide (41) to the hub (37) so that the latter can be driven into rotation while remaining easily removable. This latter feature is necessary for changing the punch, which calls for the removal of the guide (41). A pulley (38) is affixed to the hub (37). Another identical pulley (40) is affixed to the motor shaft (26). The latter pulley (26) is fixed to the same hub as pulley (25), but slighly above. The two pulleys (38) and (40) are interconnected by a round belt (39) under tension which thus transmits the rotation of the motor (26) to the hub (37), and hence to the punch (35).

A single-action compressed air jack (30) is suspended from the flange (13) by its top end. The end (33) of the rod of the jack accommodates a small ball bearing so as to allow free rotation of its central portion (34). The end of the punch (35) is made such that it centers itself in the above central portion (34). A shoulder portion, located on the punch (35) and having a considerably larger diameter than the latter, serves as a vertical abutment. A compression spring (36) is inserted between the upper face of the hub (37) and either the lower face rod of the jack or the shoulder at the end of the punch (35). The spring exerts a force supporting the punch (35) against the end (34) of the rod of the jack. Consequently, the punch (35) is guided in rotation simply by the spring (36) that presses against the hub (37). This constitutes a friction guiding system. The driving torque increases with the compression of the spring, which is as it should be since the rotational torque must be at its maximum when the punch is in the low position, i.e. into the material.

To perform a punching operation, the numerical control carries out the following sequence of actions:

- displacement of the apparatus above the selected point, with the blade in the high position;
- high speed rotation of the motor (26);
- lowering of the punch (35);
- raising of the punch;
- stopping of the motor (26).

The above punching apparatus offers the following advantages:

- use of a single motor for two totally different functions;
- maximum compactness;
- highly simlified punching device, not requiring any particular rotational drive means (friction drive);
- simple assembly and dismantling, not requiring any tooling;
- very high reliability.

In order to maintain the blade throughout the cutting processes, periodic sharpening is required.

The present invention therefore also proposes to provide means for carrying out such a sharpening function automatically.

Given the compactness of the apparatus, such sharpening means must be as small as possible. As shown in FIGS. 12, 12*a* and 13, the sharpening means are affixed to the compressing heel (29). The operating principle is as follows: two small tabs (42) and (43) having abrasive pads (e.g. a diamond dust covering) affixed thereto are articulated around a common axis (48) that is set vertical with respect to the compressing heel (24). The tabs (42) and (43) are held apart by a small spring, shown in detail in FIG. 12, and positioned at a tangent to the cutting edge (20) without touching the latter. The tabs (42) and (43) have an extension (43') in the form of a vertical tab. The lower opening of the guide (22) is machined in the form of a splay so as to present an inclined, almost vertical, plane above each tab (42) and (43).

When the blade is set in the high position, the slider (21) and the pressing heel (29) rise too. Tabs (43') then come to press against the inclined planes (46) of the guide (22) and thus squeeze the tabs (42) and (43) so as to press them against the blade (20). If at that moment the blade is vibrating, they will be sharpended by their contact with the abrasive pads (44).

As soon as the blade is lowered to begin a new cutting operation, tabs (43') disengage from the inclined planes (46) and thus move the abrasive pads away from the top of the blade (by virtue of the combined action of the biasing spring (45)) and sharpening is then interrupted.

It should be noted that the implementations of the above means requires the suppression of the articulation axis (47) around the compressing heel with respect to the slider (21).

In addition to their extreme compactness, the above sharpening means have the advantage of automatically compensating for wear of the blade. Moreover, no specific background command is required since sharpening occurs sytematically each time the blade is raised.

What is claimed is:

1. Cutting and punching apparatus for sheet material, designed to be movably mounted on an automatic cutting machine, having a cutting tool and a punching tool, wherein said apparatus comprises means for vibrating said cutting tool, means for vertically displacing said cutting tool, means for rotating said cutting tool, means for sharpening said cutting tool, means for vertically displacing said punching tool, means for rotating said machine tool, and a supporting base on which are grouped in a compact manner all said means, which all said respective means being operable both simultaneously and independently of each other.

2. Apparatus as claimed in claim 1, wherein said cutting tool is a vertical blade.

3. Apparatus as claimed in claim 1, wherein said punching tool is a vertical punch.

4. Apparatus as claimed in claim 2, wherein said means for vibrating said cutting tool include a flywheel coupled directly to the shaft of an electric motor affixed inside a movable casing, a freely rotatable crank wrist mounted on the external face of said flywheel, at an excentric position with respect to the rotation axis of said flywheel and possessing an open, radial slot in which comes to slide horizontally a T-shaped tongue element of a slider adjusted so as to slide freely and without rotation on a hollow guide whose axis is concurrent with that of said flywheel, said slider coming into engagement at the upper part of said blade while allowing free rotation of the latter.

5. Apparatus as claimed in claim 4, wherein said slider has a vertical sleeve possessing a square internal section adjusted on said guide.

6. Apparatus as claimed in claim 4, wherein said blade is vertically guided by a slider that is itself vertically guided within a rotating guide mounted on said base.

7. Apparatus as claimed in claim 6, wherein a guiding section between said slider and said guide is square to prevent any rotation of one with respect to the other.

8. Device as claimed in claim 6, wherein said slider bears, at its lower part located beneath said guide, a pressing heel to flatten the cutting material onto its cutting support.

9. Apparatus as claimed in claim 2, wherein said means for vertically displacing said cutting tool comprise a pneumatic jack, two guide columns held at their top ends by a connecting element, a compression spring located between said base and said movable casing enclosing said electric motor.

10. Apparatus as claimed in claim 2, wherein said means for rotating said cutting tool comprises servo-motor connected, via a toothed transmission belt and two pulleys, to said rotating guide driving said blade into rotation.

11. Apparatus as claimed in claim 10, wherein said servo-motor is vertically mounted on a support that is articulated with respect to said base for adjustment of the tension of said belt.

12. Apparatus as claimed in claim 2, wherein said means for sharpening said cutting tool comprise:

two abrasive tabs articulated around a common vertical axis joined to said pressing heel and held apart by a spring so as to be at a tangent with respect to the blade without contacting the latter, inclined planes provided at the lower opening of said guide and serving to squeeze said tabs into contact with said blade when the latter is set to a high position.

13. Apparatus as claimed in claim 3, wherein said means for vertically displacing said punching tool comprises:

a pneumatic jack affixed to said connecting element;

a guide means movably suspended in a rotating hub of said base, the lower part of said punching tool sliding through said guide and its upper part being centred on the end of the rod of said jack;

a compression spring located between the upper face of said hub and the lower face of the rod of said jack, and through which passes said punch.

14. Apparatus as claimed in claim 3, wherein said means for rotating said punching tool comprise a motor, pulleys, joined respectively to said hub and to said shaft of said motor, on which a circular belt is mounted under tension.

15. Apparatus as claimed in claim 10, wherein said motor drives both the means for rotating said cutting tool and the means for rotating said cutting tool.

* * * * *